US005200605A

United States Patent [19]

Satoh et al.

[11] Patent Number: 5,200,605

[45] Date of Patent: Apr. 6, 1993

[54] OPTICALLY FUNCTIONAL DEVICE WITH INTEGRAL RESISTANCE LAYER

[75] Inventors: Shiro Satoh, Ogawara; Yasuhiro Osawa, Sendai, both of Japan

[73] Assignees: Ricoh Company, Ltd., Tokyo; Ricoh Research Institute of General Electronics Co., Ltd., Natori, both of Japan

[21] Appl. No.: 834,210

[22] Filed: Feb. 12, 1992

[30] Foreign Application Priority Data

Feb. 13, 1991 [JP] Japan ..... 3-41213

[51] Int. Cl.[5] ..... H01J 31/50

[52] U.S. Cl. ..... 250/214 LS; 250/214.1

[58] Field of Search ..... 250/211 R, 211 J, 213 A; 357/19; 359/245

[56] References Cited

U.S. PATENT DOCUMENTS 4,782,223 11/1988 Suzuki ..... 250/213 A 4,952,791 8/1990 Hinton et al. ..... 250/211 J

*Primary Examiner*—David C. Nelms

*Attorney, Agent, or Firm*—Oblon, Spivak, McClelland, Maier & Neustadt

[57] ABSTRACT

An optically functional device has a semiconductor substrate, a light receiving portion disposed on the semiconductor substrate for receiving input light, a light emitting portion disposed on the light receiving portion for emitting output light, a window disposed above the light emitting portion, through which input light and output light pass and a resistance layer made of a semiconductor for functioning as load resistance. The resistance layer is disposed at least in either place between the semiconductor substrate and the light receiving portion, or between the light receiving portion and the light emitting portion, or on the light emitting portion. The light emitting portion has a light emitting layer made of semiconductor material having an energy of forbidden band width of more than the energy of a main peak of input light. The light receiving portion has a base and a collector each of which is made of a semiconductor material having an energy of forbidden band width equal to or less than the energy of a main peak of input light. The light emitting portion is adapted to feed back a part of the output light to the light receiving portion. Thereby a nonlinear output response to input light is performed based on the feedback effect of the output light absorbed by the light receiving portion.

8 Claims, 7 Drawing Sheets

OPTICALLY FUNCTIONAL DEVICE WITH INTEGRAL RESISTANCE LAYER

BACKGROUND OF THE INVENTION

1. Field of the Invention

The present invention relates to an optically functional device for use as optically operational devices and memories in optical information processing apparatuses, particularly relates to an optically functional device which is applicable to information processing apparatuses having image processing functions and neutral net functions operated with light, or which may be applied to various controlling apparatuses in use of these functions.

2. Description of the Related Art

Performing arithmetical operations and memory operations using light requires so-called optically functional devices, or the devices in which a light output is emitted in a nonlinearly responding manner in accordance with a light input.

As a first referential example, there has been proposed an optically functional device configurated as shown in FIG. 7 (a document: refer to J. Lightwave Technology vol. LT-3 (1985) 1264). This optically factional device is one, as detailed in the aforementioned document, in which a so-called thyristor structure consisting of pnpn-layers is formed.

With respect to this device, there are provided a light emitting portion in the upper portion comprising three layers, (specifically, p-InP Confining Layer, N-InGaAsP Active Layer, and n-InP Confining Layer), a transistor (HPT; Hetero Bipolar Transistor) in the lower portion comprising four layers (n-InP, n-InGaAsP buffer, p-InGaAsP Gate, and n-InP Emitter) and a pair of metal layers, functioning as electrodes, being disposed on the upper and lower surfaces of the device. As to this device, with the state that electric field is applied between the electrodes, when light is inputted from the rear side of the substrate, the HPT is turned to ON to flow current, thus causing the light emitting portion to emit light upward. At this time, a part of the emission is inputted into the HPT, this light becomes a so-called feedback light, causing a nonlinear operation.

FIG. 8 shows the operation of the device schematically. In FIG. 8, the current is taken along the axis of ordinate, the applied voltage is taken along the axis of abscissa, the thyristor characteristic of the pnpn-structure is represented with a solid line, and the operational line based on the load resistance existing in the system is denoted by broken line.

In FIG. 8, with increase in the input light intensity, the break down voltage $V_B$ changes in the order of 1→2→3, furthermore, in accordance with this change, the state of intersection points with the operational line also changes from two points P and Q to a sole point Q. More, specifically, in a case where the input light intensity corresponds to the state of 1 or 2, as is apparent there exit two stable points forming a so-called bistable state. (In this figure, $V_A$ denotes the applied voltage, and $R_L$ the load resistance value.)

Consequently, as shown in FIG. 9, the nonlinear operations, that is, respective characteristics such as differential gain (a), bistability (b) and optical switch (c), can be obtained in accordance with applied voltages. Further, the respective characteristics can be acquired when the value of the load resistance is varied.

FIG. 10 is an operational principle diagram showing aforementioned optically functional device by using an equivalent circuit. In the figure, reference numerals 21, 20, and 22 represent the HPT, the light emitting device and the load resistance, respectivly, meanwhile, reference numerals 24 25 and 26 denote respectively the feed back light, the output light outward, and the input light into the HPT.

As a second referential example, there is also a device which is disclosed in "Technical Digest, 20C3-2, Integrated Optics and Optical-fiber Communication (IOOC), 1989, Kobe, Japan." This device has mostly the same structure with the first referential example. Either of these examples needs to be operated by connecting in series with an appropriate load resistance. At this time the load resistance value is to be selected in accordance with the input light intensity and applied voltage used and the desired character.

For optically functional devices in addition to the aforementioned two examples, there is a third kind of structure, which is shown in a patent application No. 73908/1990 applied by the present inventor. The structure of the device of this prior application is shown in FIG. 11. The operation and operational principle of the device based on this preceding invention is the same as the aforementioned referential examples, and the behaviors of its operation are as shown in FIGS. 8 and 9, and the equivalent circuit is expressed in FIG. 10.

The device of this invention is an optically functional semiconductor device which has a light receiving portion I disposed on a semiconductor substrate 2, a light emitting portion II thereon, and which is equipped on the side of the light emitting portion with a window 10 through which the input light and output light goes in and out. In this arrangement, the light emitting portion II is made of a semiconductor material having an energy of forbidden band width of more than the energy of a main peak of input light, and the light receiving portion I is made of a semiconductor material having an energy of forbidden band width equal to or less than the energy of a main peak of input light, and the optically functional device characteristically receives and feeds back by means of the receiving portion I a part of output light generated from the light emitting portion II and performs a nonlinear output light response to input light based on the feedback effect of the absorbed light by means of the light receiving portion I. Consequently, The light emitting portion can be commonly used as the input window, thus making it possible that input light and output light can be respectively, received by and emitted from, the same position. Furthermore, it is possible that the wavelength of the input light can be differed from that of the output light, so that input light can be easily separated.

In FIG. 11 is a sectional view showing a structure of the aforementioned optically functional device, the layers structures are formed of, from the bottom in the order, a rear electrode 1, an n-type GaAs-substrate 2, an n-$Al_{0.4}Ga_{0.6}As$ layer 3, a p-GaAs layer 4, an n-GaAs layer 5, an n-$Al_{0.4}Ga_{0.6}As$ layer 6, a p-$Al_{0.4}Ga_{0.6}As$ layer 7, a p-GaAs layer 8 and another electrode 9. In this arrangement, the portion I serves as a light receiving portion (3, 4 and 5) being formed as an HPT, and the portion II works as a light emitting portion (6 and 7). Reference numeral 10 denotes the input/output window of light, and the progressing directions of the input and output light are shown by arrows 11. The device of this example is also required to be connected to an appropriate load resistance in series for operation. At this time, the value of the load resistance is selected in accordance with the input light intensity and applied voltage used and the desired characteristic. This may be understood from the fact that the gradient of the operational line as shown with a broken line varies depending upon the value of the load resistance. For example, if the value of the load resistance increases and thus the gradient becomes small (the line becomes laid down), the bistable state which has two stable points P and Q comes to exist even for a low current, and simultaneously, the current difference between P and Q, or specifically, the light output difference between ON state and OFF state (ON-OFF ratio) becomes small.

Now, in the case where the optically functional device according to the aforementioned referential example is to be operated, a load resistance having an appropriate resistance value is connected in series to the device for the purpose of acquiring a desired performance. Particularly, when devices are set in two-dimensional array arrangement, each device is required to be connected with a load resistance. This is because that in a case where a common load resistance $R_L$ is connected to the optically functional devices-array as shown in FIG. 12, if any one of the optically functional devices is turned to ON, the rest optically functional devices cannot be applied with required voltages, and thus cannot be brought into operation.

It is impossible, however, that load resistances are one by one joined as in an after-treatment to the array of respective optically functional devices of some tens to some hundreds microns (μm) in diameter, so that the resistance value is naturally determined by the resistance in total of the semiconductor substrates and semiconductor layers forming the light-emitting portion and light-receiving portion. This is because that in order to achieve required performances for the light-emitting portion and the light-receiving portion, the layers forming the respective portions have to be optimized in their compositions and carrier densities. For this reason, the resistance value cannot be taken as an independent parameter, and this fact limits the resulting device in its performance and operation, thus diminishing the freedom in device-designing.

SUMMARY OF THE INVENTION

The present invention has been achieved in view of what is discussed above, and it is therefore an object of the present invention to provide an optically functional device which emits output light from its top and receives input light at the same top and may have a different peak frequency of the input light from that of the output light, and wherein a load resistance can be monolithically integrated for each device in a case where a plurality of such optically functional devices are set in two-dimensional array arrangement, and its value can be set up as an independent parameter regardless of the resistance values of the semiconductor layers and semiconductor substrates which form a light emitting portion and light receiving portion.

The above-mentioned object of the present invention can be achieved by an optically functional device comprising, a semiconductor substrate, a light receiving portion disposed on said semiconductor substrate for receiving input light, a light emitting portion disposed on the light receiving portion for emitting output light, a window disposed above the light emitting portion, through which input light and output light pass, and a resistance layer made of a semiconductor for functioning as load resistance, the resistance being disposed at least in either place between the semiconductor substrate and the light receiving portion, or between the light receiving portion and the light emitting portion, or on said light emitting portion, the light emitting portion comprising a light emitting layer made of semiconductor material having energy of a forbidden band width more than energy of a main peak of input light, the light receiving portion comprising a base and a collector each of which is made of a semiconductor material having energy of a forbidden band width equal to or less than energy of a main peak of input light; and, said light emitting portion being adapted to feed back a part of said output light to said light receiving portion, thereby a nonlinear output response to input light being performed based on the feedback effect of said output light absorbed by said light receiving portion.

Description of structure and operation of the present invention will be in detail made hereinafter.

In the optically functional device of the present invention, having the aforementioned structure, the light emitting portion can be used commonly as an input window, thus making it possible that input light and output light can be respectively, received by and emitted from, the same position. Furthermore, it is possible that the wavelength of the input light can be differed from that of the output light so that light input can be easily separated.

With respect to the optically functional device of the present invention, the layers structure is configurated such that there are provided a semiconductor layer for resistance on a first electric conduction type semiconductor substrate; above it, three layers constituting an HPT comprising a first electric conduction type semiconductor layer for emitter (having an energy of $E_1$ in its forbidden band width), a second electric conduction type semiconductor layer for base (of $E_2$ in the same way), and a first electric conduction type semiconductor layer for collector (of $E_3$ in the same way); and further thereabove it, a light emitting portion comprising a first electric conduction type semiconductor layer for light-confining (of $E_4$ in the same way), a semiconductor layer for active layer as a light emitting layer (of $E_5$ in the same way) and a second electric conduction type semiconductor for light-confining (of $E_6$ in the same way); and still further thereover a second electric conduction type semiconductor for electrode in this order. Here, the light emitting portion has a so-called double-hetero structure, and an opening which reaches the second electric conduction type semiconductor layer for light-confining is disposed on the second electric conduction type semiconductor for electrode to form an input/output window of light. In this arrangement, the relation between the layers of energies with respect to the forbidden band width are defined as shown below.

$$E_1 > E_3 \geqq E_2 \quad (1)$$

$$E_4 > E_5,\ E_6 > E_5 \quad (2)$$

$$E_5 > E_3 \geqq E_2 \quad (3)$$

Metal layers for electrode having an ohmic characteristic are formed on both the second electric conduction type semiconductor layer and the rear face of the substrate, making it possible to impress between the pair of the electrodes a voltage producing a forward bias with respect to the emitter and base. In this arrangement, when light input is effected from the input/output window in the state of being applied by the voltage, the devices is turn to ON and thus emits light. At this time, the sum of the resistances of the semiconductor substrate, the light-emitting portion, the HPT portion at the ON-state, and the semiconductor layer for resistance works as the load resistance, and the combination of the value and the applied voltage defines an operational line, on which the device operates and emits output light behaving nonlinearly with respect to the input light. Since $E_3<E_4$ holds in this device, this allows the depletion layer extending from the base-collector interface to the interface between the collector and the first electric conduction type semiconductor for light-confining, to effectively absorb the light generated in the active layer to produce a feedback.

In the case where the optically functional devices are arrayed in two-dimension, the devices having the aforementioned layers structure are formed like an array on a common first electric conduction type semiconductor substrate. In this structure, slots are formed extending from the uppermost layer of devices to, at least, the semiconductor layer for resistance, to thereby electrically separate individual devices from their adjoining ones. This makes it possible to operate respective devices independently.

Here, the semiconductor layer for resistance is not required to be disposed between the semiconductor substrate and the first electric conduction type semiconductor layer for emitter, but may be disposed between the first electric conduction semiconductor layer for collector and the first electric conduction semiconductor layer for light-confining, or between the second electric conduction type semiconductor layer for light-confining and the second electric conduction type semiconductor layer for electrode.

The semiconductor layer for resistance disposed between the first electric conduction type semiconductor layer for collector and the first electric conduction type semiconductor layer for light-confining is required to have a forbidden band width of wider than $E_5$, more preferably wider than $E_4$. This is because that in this case the absorption of, by the semiconductor layer for resistance, the input light to reach the HPT and the feedback light from the light emitting portion is required to be lessened as much as possible.

In the case where the window for the input/output light reaching the second electric conduction type semiconductor layer for light-confining is not disposed on the semiconductor layer for resistance located between the second electric conduction type semiconductor layer for light-confining and the second electric conduction type semiconductor layer for electrode, the forbidden band width in the semiconductor layer for resistance is required to be wider than $E_5$, preferably is wider than $E_6$. This is because that in order to improve the efficiency in extraction of light, it is preferable to diminish absorption of output light by semiconductor layer for resistance. On the other hand, when there is provided the window for the input/output light, there is no restriction for the forbidden band width of the semiconductor layer for resistance. The reason is that it is necessary to transmit the input light and the emitted light.

Furthermore, the light emitting layers constituting the light emitting portion are not limited to have a double-hetero structure, but may comprise a first electric conduction type semiconductor layer (having a forbidden band width of $E_7$) with a second electric conduction type semiconductor layer (having a forbidden band width of $E_8$) being thereon, or is composed by so called single hetero structure. In the case, the relations of the forbidden band widths are to be determined as follows:

$$E_7>E_3\geqq E_2,\ E_8>E_3\geqq E_2.$$

As detailed above, the optically functional device of the present invention, it is possible to produce various semiconductor layers for resistance having different values by taking as parameters conditions for filmforming and composition ratio, of the semiconductor layer for resistance and layer thickness and device cross section, and this enables the semiconductor layer for resistance to function as a load resistance. Therefore, a resistance having a required resistance value for acquiring a desirable operation mode can be formed monolithically inside the device structure. Furthermore, in the case where devices are arrayed two-dimensionally or one-dimensionally, it is possible to perform operation mode control by controlling the resistance value for each device part. More specifically the device can be operated, with respect to nonlinear operation of output light in response to input light, in any of bistability mode, differential gain mode or optical switch mode, from which the operation mode of the device can be selected by controlling the resistance value for each device part.

Further objects and advantages of the present invention will be apparent from the following description of the preferred embodiments of the invention as illustrated in the accompanying drawings.

DESCRIPTION OF THE PREFERRED EMBODIMENTS

The present invention will be hereinafter described in detail based on embodiments with being shown in drawings.

Figure 1:
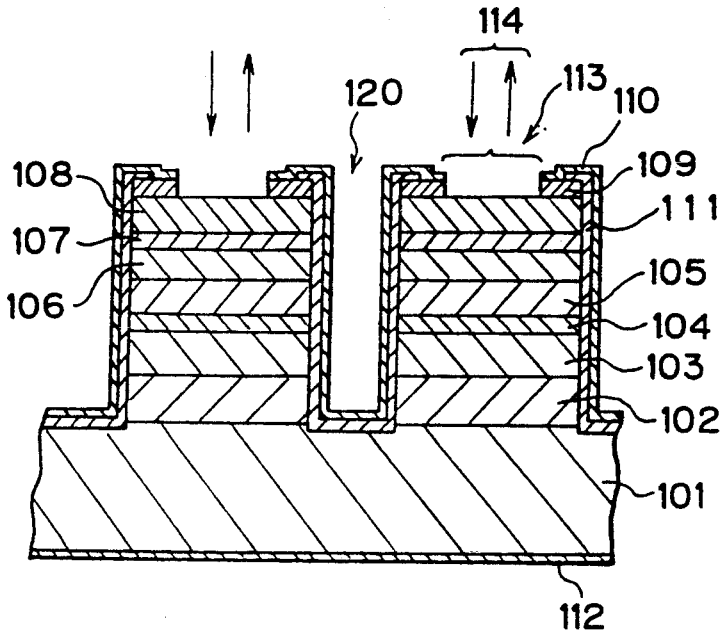
FIG. 1 is a main portion sectional view of an optically functional device showing a first embodiment of the present invention.
Figure 2:
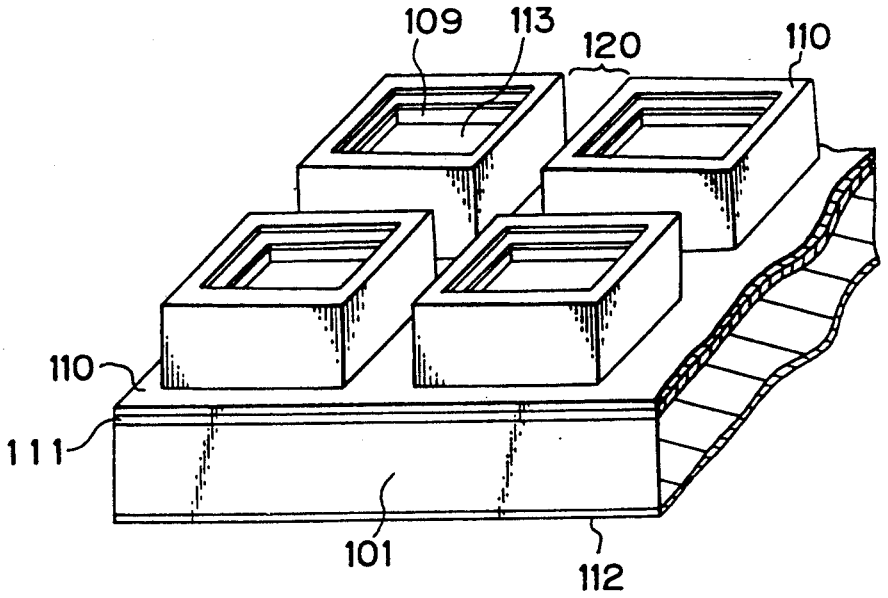
FIG. 2 is a perspective view of an optically functional device showing the first embodiment of the present invention.

FIG. 1 is a main portion sectional view showing a first embodiment of an optically functional device of the present invention, and FIG. 2 shows its perspective view, in which 2×2 part of an n×n array is illustrated. Both of these figurers illustrate array structures, in which there is provided by the MOCVD method (Metalorganic Chemical Compound Vapor Deposition method) in layers as in the following order, an n-type GaAs-substrate 101 as a bottom layer, an $Al_{0.4}Ga_{0.6}As$ semiconductor layer for resistance 102 (with 2 micrometers thick), an n-type $Al_{0.4}Ga_{0.6}As$ semiconductor layer for emitter 103 (with 1 micrometer thick), a p-type GaAs semiconductor layer for base 104 (with 0.05 micrometer thick), an n-type GaAs semiconductor layer for collector 105 (with 1 micrometer thick), an n-type $Al_{0.4}Ga_{0.6}As$ semiconductor layer for light-confining 106 (with 1 micrometer thick), an $Al_{0.2}Ga_{0.8}As$ semiconductor layer for active layer 107 (with 0.2 micrometer thick), a p-type $Al_{0.4}Ga_{0.6}As$ semiconductor layer for light-confining 108 (with 1 micrometer thick), and an p-type GaAs semiconductor layer for electrode 109 (with 0.4 micrometer thick). In addition, each device has a hole reaching the semiconductor layer for light-confining 108 as a light input/output window 113 disposed in the semiconductor layer for electrode 109. In the figure, arrows 114 shows the directions of the input light and the output light.

Between devices are formed a slitting slots 120 by dry-etching method from the top layer of the semiconductor structure, i.e. the semiconductor layer for electrode 109, reaching the substrate 101. In this embodiment, the slots 120 is 15 micrometer wide. Meanwhile, in the bottom of slots, on the side of devices and on the peripheral portion of the top of the semiconductor layer for electrode 109, there is provided an $SiO_2$ insulator film 111 is deposited in layer for the purpose of electrically insulation and surface protection. Furthermore, on the $SiO_2$ insulator film 111 as well as on the portion in which the $SiO_2$ insulator film is not covered but the semiconductor layer for electrode 109 is exposed is formed an Au-Zn metal layer 110 for ohmic electrode, whereas an Au-Ge-Ni metal layer 112 is formed on the rear surface of the substrate 101. As shown in FIG. 2, each device was shaped into a quadratic prism having a base of 20 μm×20 μm square, and the resulting device resistance was 15 ohm, and the $Al_{0.4}Ga_{0.6}As$ semiconductor layer for resistance 102 had a resistance of 10 ohm.

Figure 9:
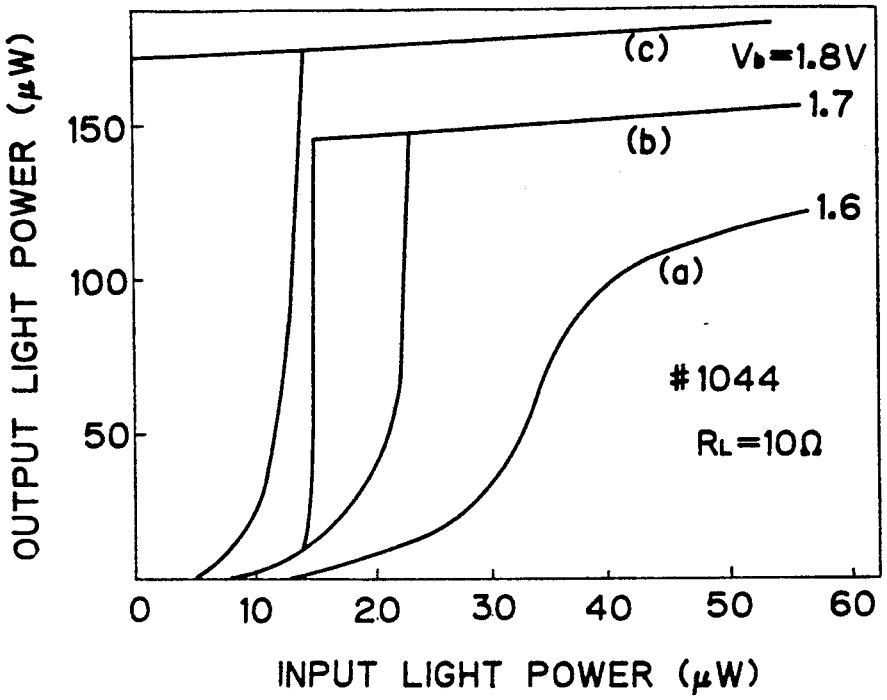
FIG. 9 is a diagram showing operations of an optically functional device.
Figure 10:
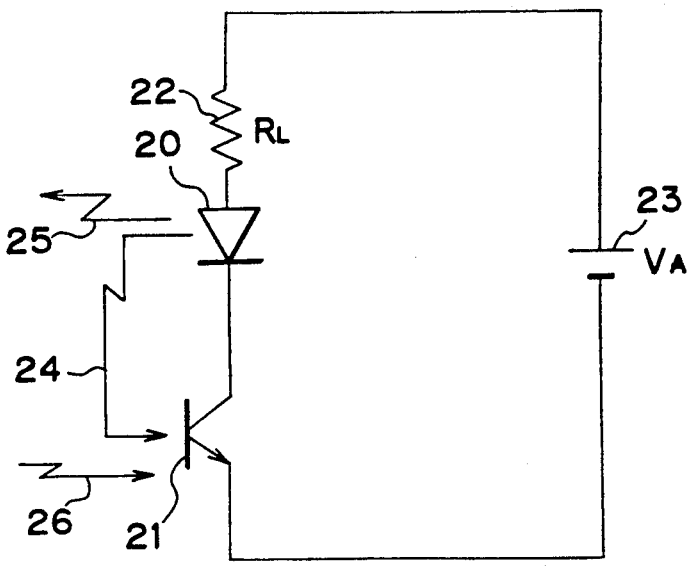
FIG. 10 is an equivalent circuit diagram of an optically functional device.
Figure 11:
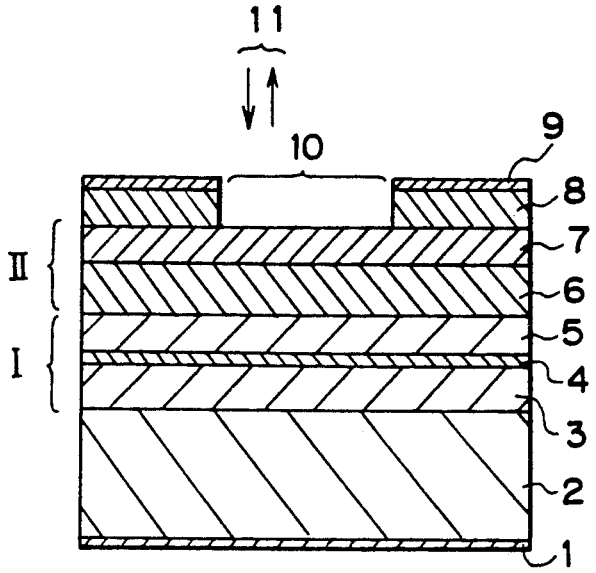
FIG. 11 is a sectional view showing an optically functional device according to the third referential example (prior application); and, FIG. 12 is a circuit diagram showing a bad connecting arrangement of an array of optically functional devices.
Figure 12:
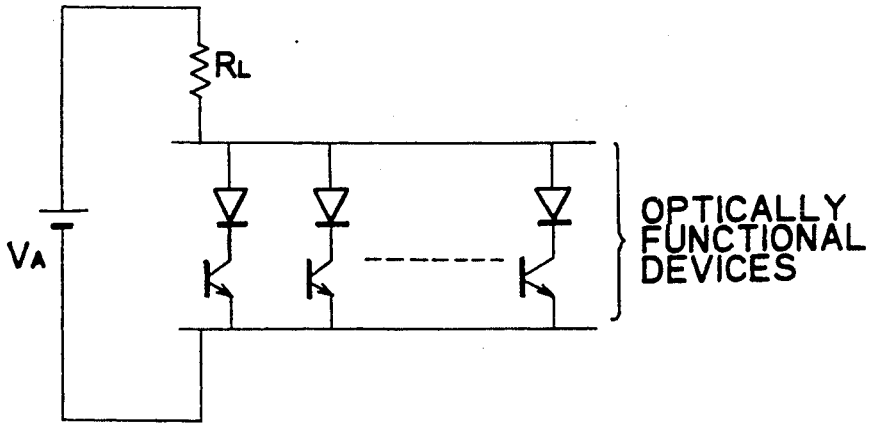

Now, in the case where a voltage (positive to the electrode 110, and negative voltage to the electrode 112, was applied between the electrodes of device of this embodiment, light with a peak wavelength of 780 nm was made to enter the input/output light window 113 to turn the device to ON; the resulting output light had a peak wavelength of 760 nm. As a result, an optical bistability characteristic similar to that shown in FIG. 9 was obtained with respect to the input light. It should be noted that in the same applied voltage and input light intensity, the operation mode of the device varies from an optical bistability character to a differential gain character when the resistance value is taken to be larger, whereas it changes from an optical bistability character into an optical switch character when the resistance value is taken to be smaller.

Figure 3:
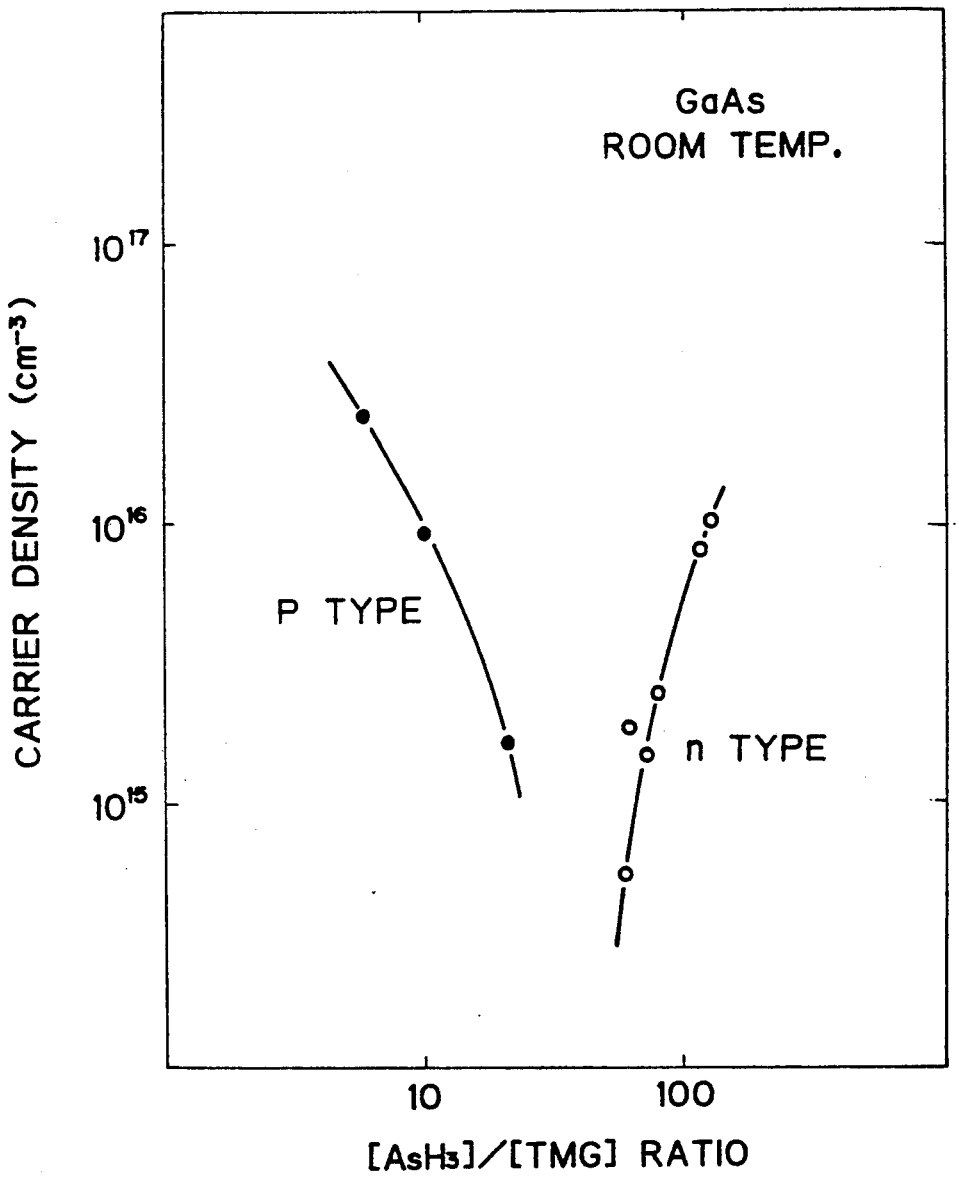
FIG. 3 is a graph plotting the growth-dependence at room temperature of carrier density in GaAs prepared by the MOCVD method.
Figure 4:
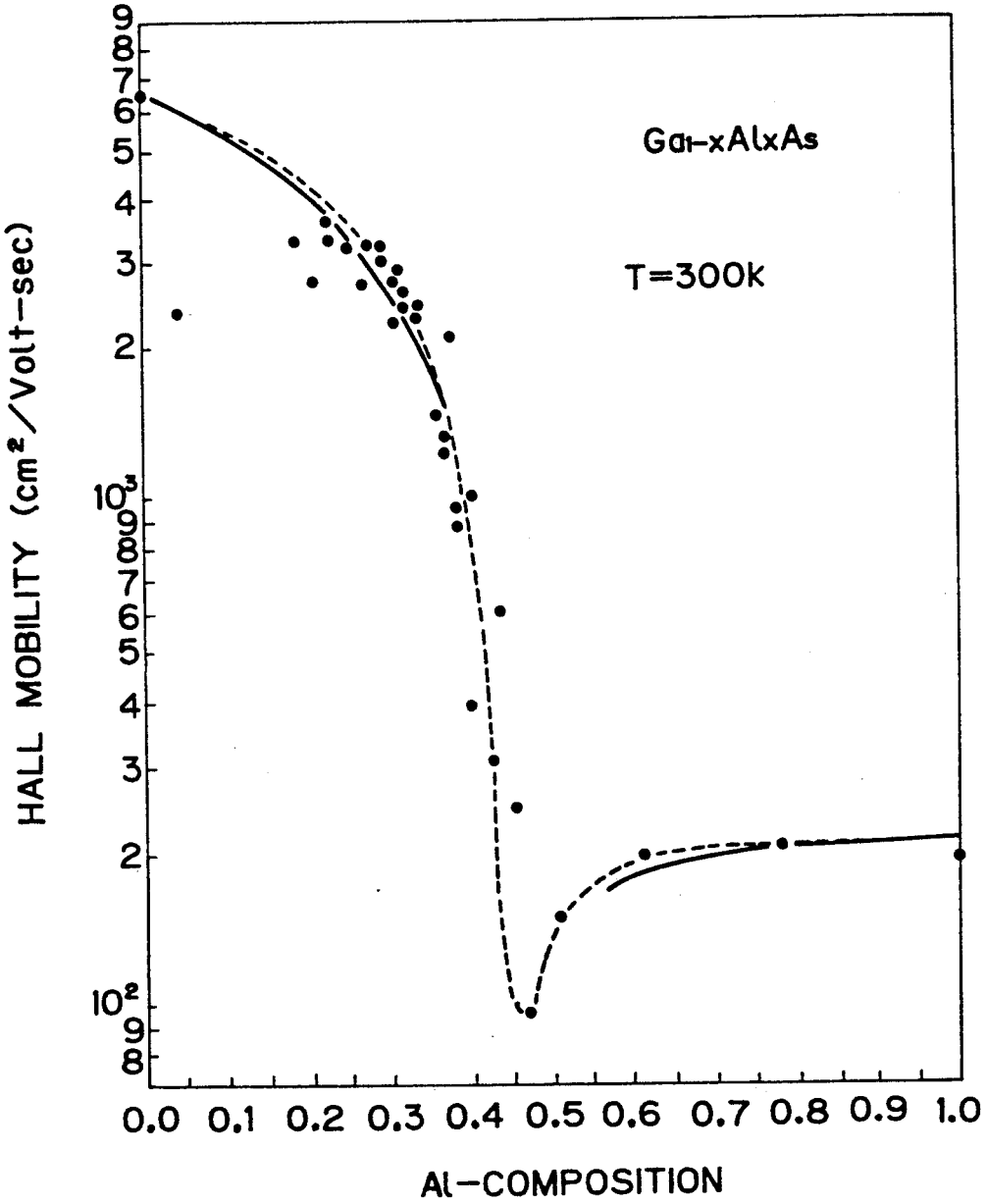
FIG. 4 is a graph plotting Al-composition dependence at room temperature of Hall mobility of electron in AlGaAs prepared by the MOCVD method.

In the MOCVD method used as the film-forming method of this embodiment, as is shown in the experimental data of FIG. 3, on film-forming, the carrier density is largely changes depending on a ratio of arsin ($AsH_3$) to trimethyl gallium (TMG) both of which are the starting materials of GaAs. The same can be said for the case of AlGaAs. In addition, it is understood as shown in FIG. 4 (III-V group alloy crystal semiconductor data book, P. 25; edited by Japan Electronic Industry Development Association) the carrier mobility also changes in a large quantity, depending not only on the composition ratio of the starting materials, but also on the Al-composition ratio in AlGaAs.

In this connection, electric conductivity $\sigma$ and resistance R are expressed respectively as follows:

$$\sigma = ne\mu, R = L/\sigma S \quad (4)$$

where n: carrier density, e: unit electric charge, $\mu$ : carrier mobility, L: length (which corresponds to the thickness of the semiconductor layer for resistance in the invention), and S: cross section (which, in this invention, corresponds to a cross section of each device in parallel with the substrate surface.

As is apparent from the expression (4) and FIGS. 3 and 4, it is possible to produce semiconductor layers for resistance having different resistance values by taking as parameters film-forming condition, the Al-composition ratio in AlGaAs, the layer thickness and the device cross section. Consequently, without connecting any external resistance as load resistance, a resistance having a required resistance value for acquiring a desirable operation mode can be formed monolithically inside the device structure. Furthermore, in the case where devices are arrayed two-dimensionally or one-dimensionally, it is possible to perform operation mode control by controlling the resistance value for each device part.

Figure 5:
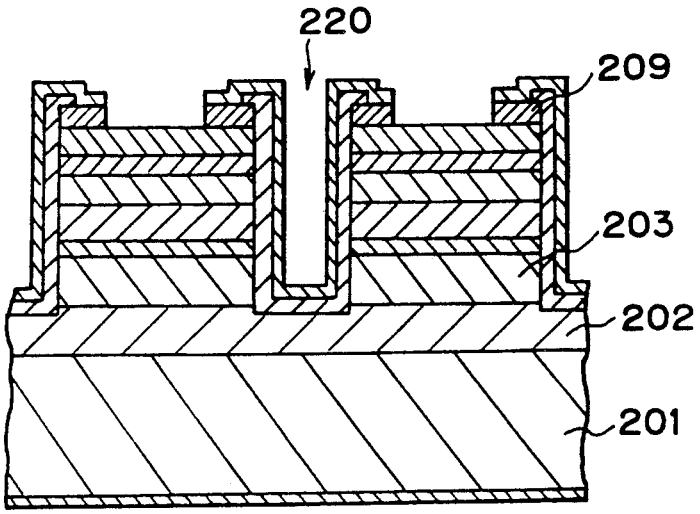
FIG. 5 is a main portion sectional view of an optically functional device showing a second embodiment of the present invention.

Next, FIG. 5 is a sectional view showing an optically functional device as a second embodiment of the present invention. This example illustrates like the first embodiment an optically functional devices structured in array arrangement.

Like the first embodiment, in this embodiment, there is also provided in layers on an n-type GaAs-substrate 201, an $Al_{0.4}Ga_{0.6}As$ semiconductor layer for resistance 202, and an n-type $Al_{0.4}Ga_{0.6}As$ semiconductor layer for emitter 203, and the same structure as illustrated in the first embodiment are formed thereon.

Between individual devices are formed a slitting slots 220 from the top layer of the semiconductor structure, i.e. the semiconductor layer for electrode 209, reaching the semiconductor layer for resistance 202, to thereby separate individual devices electrically and spatially.

In the case of this embodiment, as the same manner with the first embodiment, each device is shaped with slots having a width of 15 μm into a quadratic prism having a base of 20 μm×20 μm square. In a case where the semiconductor layer for resistance is 2 μm thick, the resistance of the semiconductor layer for resistance with respect to the current path normal to the substrate is not more than 1.5% of the resistance between adjoining devices on the semiconductor layer for resistance. As a result, even though the semiconductor layer for resistance is not split electrically, the current passing through the semiconductor layer for resistance into the adjoining devices can be neglected. Therefore, it is possible in this embodiment to obtain the same effect with the first embodiment, and consequently, without connecting any external resistance as load resistance, a resistance having a required resistance value for acquiring a desirable operation mode can be formed monolithically inside the device structure. Furthermore, in the case where devices are arrayed two-dimensionally or one-dimensionally, it is possible to perform operation mode control by controlling the resistance value for each device part. Moreover, this embodiment has an advantage that the slitting slots 220 can be reduced in depth.

In this connection, if the semiconductor layer for resistance have a thickness of t, and a slot width of W, and one side of the device is Ls in length; the ratio of the resistance on the semiconductor layer for resistance between adjoining devices to the resistance of the semiconductor layer for resistance with respect to current path normal to the substrate is represented by $t^2/LsW$. Since each point of the semiconductor layer for resistance has an almost equal potential to other points, if the current between adjoining devices is $t^2/LsW < 1$, it can be mostly negligible.

Figure 6:
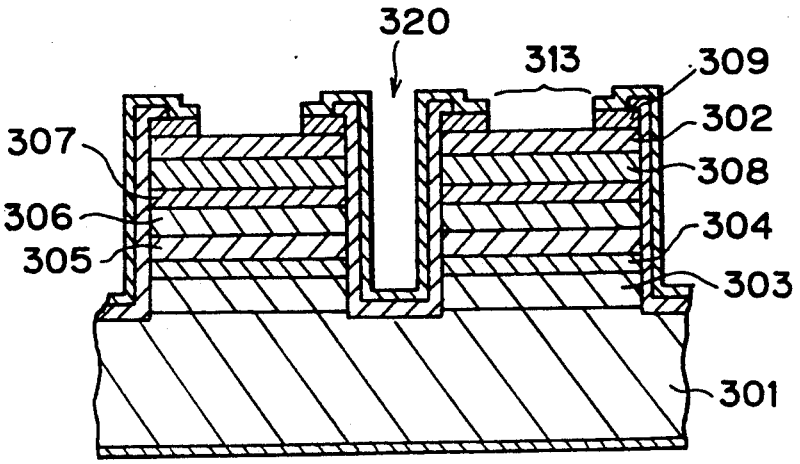
FIG. 6 is a main portion sectional view of an optically functional device showing a third embodiment of the present invention.
Figure 7:
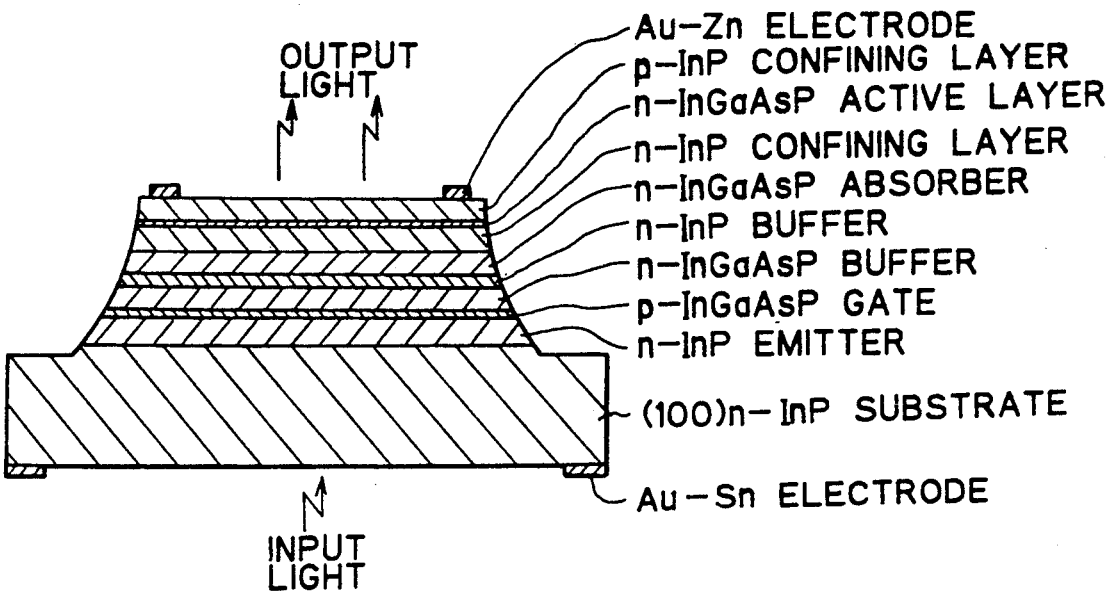
FIG. 7 is a sectional view of an optically functional device according to a first referential example.
Figure 8:
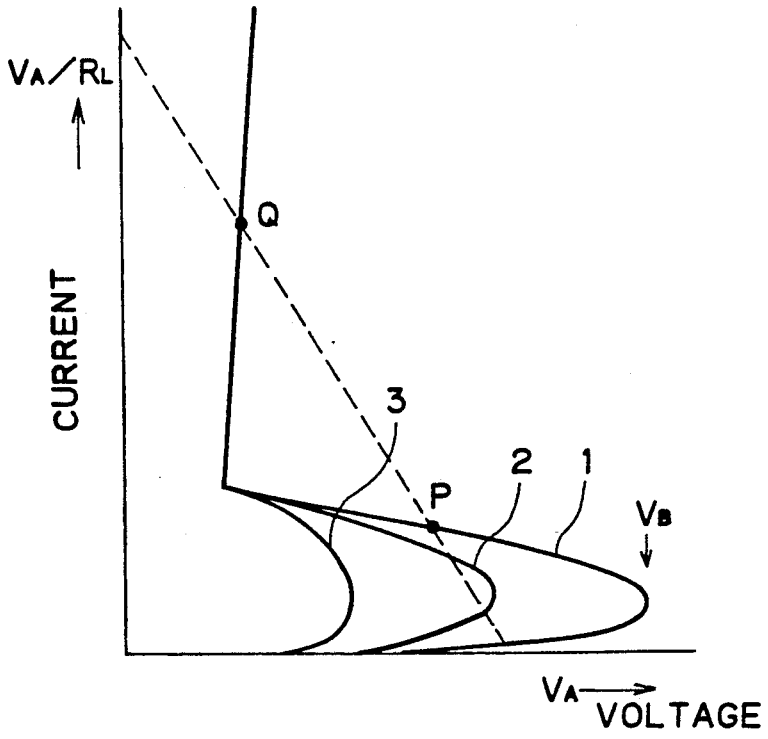
FIG. 8 is a diagram for illustrating operation of an optionally functional device.

Next, FIG. 6 is a sectional view showing an optically functional device as a third embodiment of the present invention. This example illustrates like the first embodiment an optically functional devices structured in array arrangement.

In this embodiment, there is provided in layers on an n-type GaAs-substrate 301, an n-type $Al_{0.4}Ga_{0.6}As$ semiconductor layer for emitter 303, and the same structure in the first embodiment is formed thereon, specifically, a p-type GaAs semiconductor layer for base 304, an n-type GaAs semiconductor layer for collector 305, an n-type $Al_{0.4}Ga_{0.6}As$ semiconductor layer for light-confining 306, an $Al_{0.2}Ga_{0.8}As$ semiconductor layer for active layer 307, an p-type $Al_{0.4}Ga_{0.6}As$ semiconductor layer for light-confining 308 are formed in layers in this order. Above this structure, there is provided in layers an $Al_{0.4}Ga_{0.6}As$ semiconductor layer for resistance layer 302, and a p-type GaAs semiconductor layer for electrode 309, in which a hole reaching the semiconductor layer for resistance 302 is formed as a light input/output window 313. Between individual devices are formed a slitting slots 320 from the top layer of the semiconductor structure, i.e. the semiconductor layer for electrode 309, reaching the substrate 301.

Also in this embodiment the same effect with the first embodiment can be performed, and consequently, without connecting any external resistance as load resistance, a resistance having a required resistance value for acquiring a desirable operation mode can be formed monolithically inside the device structure. Furthermore, in the case where devices are arrayed two-dimensionally or one-dimensionally, it is possible to perform operation mode control by controlling the resistance value.

In this embodiment, the energy of the forbidden band width of the semiconductor layer for resistance 302 is, at least, that of the semiconductor layer for active layer 307 or more, preferably is more than that of the semiconductor layer for light-confining 308. This is because that it is preferable to reduce the absorption of output light by the semiconductor layer for resistance in order to improve the efficiency in extraction of light.

In a fourth embodiment of the present invention, the same layers structure with the third embodiment is provided with a hole as an input/output window 313 penetrating from the p-type GaAs semiconductor layer for electrode 309 through the semiconductor layer for resistance layer to the p-type $Al_{0.4}Ga_{0.6}As$ semiconductor layer for light-confining 308. In this case, the forbidden band width of the semiconductor layer for resistance is not subject to any restriction unlike the third embodiment. Here, the same effect with that of the third embodiment can be obtained also in this embodiment.

As a fifth embodiment, it may be possible to provide a semiconductor layer for resistance layer on the top layer of an HPT, or in other word, between, in the first embodiment, the n-type GaAs semiconductor layer for collector and the n-type $Al_{0.4}Ga_{0.6}As$ semiconductor layer for light-confining of the downmost layer of the light-emitting portion. In this case, it is necessary to reduce as much as possible the absorption, by the semiconductor layer for resistance layer, of the input light to reach the HPT and the feedback light from the light-emitting portion. To fulfil this requirement, the energy of the forbidden band width of the semiconductor layer for resistance layer is required to be more than, at least, that of the semiconductor layer for active layer, and is preferably more than that of the semiconductor layer for light-confining.

It should be noted that as for the film-forming method of preparing the device structure, MBE (molecular beam epitaxy) method, LPE (liquid phase epitaxy) method other than MOCVD method can be applied to the present invention. The process of the slot-forming is not limited to the dry etching using a chlorine compound gas, but can be practiced by wet etching. In relation to the insulating film, a silicon nitriding film may be applicable other than $SiO_2$. Relating to the electric conduction types of the semiconductor substrate and semiconductor layers constituting a device, types of respective layers indicated in the embodiments can be reversed. The material for the semiconductor substrate and semiconductor layers are not specified to the AlGaAs-compounds, but can be substituted by InP, InGaAsP, InGaP, GaSb or the like.

Many widely different embodiments of the present invention may be constructed without departing from the spirit and scope of the present invention. It should be understood that the present invention is not limited to the specific embodiments described in the specification, except as defined in the appended claims.

What is claimed is:

1. An optically functional device comprising:

a semiconductor substrate;

a light receiving portion disposed on said semiconductor substrate for receiving input light;

a light emitting portion disposed on said light receiving portion for emitting output light;

a window disposed above said light emitting portion, through which input light and output light pass; and a resistance layer made of a semiconductor for functioning as load resistance, said resistance layer being disposed at least in either place between said semiconductor substrate and said light receiving portion, or between said light receiving portion and said light emitting portion, or on said light emitting portion, said light emitting portion comprising a light emitting layer made of semiconductor material having energy of a forbidden band width more than energy of a main peak of input light;

said light receiving portion comprising a base and a collector each of which is made of a semiconductor material having energy of a forbidden band width equal to or less than energy of a main peak of input light, and said light emitting portion being adapted to feed back a part of said output light to said light receiving portion, thereby a nonlinear output response to input light being performed based on the feedback effect of said output light absorbed by said light receiving portion.

2. An optically functional device according to claim 1, wherein said semiconductor for resistance layer is $Al_{0.4}Ga_{0.6}As$.

3. An optically functional device according to claim 1, wherein said window is a hole bored in a semiconductor layer for electrode.

4. An optically functional device according to claim 1 is arranged in n×n array structures.

5. An optically functional device according to claim 4 is divided by a slitting slots reaching said semiconductor substrate.

6. An optically functional device according to claim 1, wherein said resistance layer is disposed between said semiconductor substrate and said light receiving portion, and a resistance of said resistance layer with respect to a current path normal to said semiconductor substrate is less than 1.5% of a resistance between adjoining devices on said resistance layer.

7. An optically functional device according to claim 6 is divided by a slitting slots reaching said resistance layer.

8. An optically functional device according to claim 1, wherein said resistance layer is disposed on said light emitting portion, and energy of a forbidden band width of said resistance layer is more than said energy of a forbidden band width of said light emitting portion.

* * * * *